United States Patent [19]

Schmolke

[11] Patent Number: 4,471,607

[45] Date of Patent: Sep. 18, 1984

[54] OPENING UNIT FOR OPEN-END SPINNING MACHINES

[75] Inventor: Karl H. Schmolke, Neuweiler, Fed. Rep. of Germany

[73] Assignee: Hollingsworth GmbH, Fed. Rep. of Germany

[21] Appl. No.: 175,771

[22] Filed: Aug. 6, 1980

[30] Foreign Application Priority Data

Aug. 10, 1979 [DE] Fed. Rep. of Germany ..... 2932562

[51] Int. Cl.[3] ..... D01H 7/895

[52] U.S. Cl. ..... 57/408; 19/105; 19/115 R; 57/301

[58] Field of Search ..... 57/58.89–58.95, 57/301, 302, 404, 411, 406, 408; 19/105, 115 R, 112, 114

[56] References Cited

U.S. PATENT DOCUMENTS 3,777,466 12/1973 Kabele ..... 57/301 X
3,839,855 10/1974 Stalder ..... 57/408
3,884,028 5/1975 Stahlecker et al. ..... 57/411 X
4,024,699 5/1977 Goldammer et al. ..... 57/408 X
4,321,788 3/1982 Alston ..... 57/408

FOREIGN PATENT DOCUMENTS 2532993 2/1977 Fed. Rep. of Germany ..... 57/58.91

*Primary Examiner*—John Petrakes
*Attorney, Agent, or Firm*—Townsend and Townsend

[57] ABSTRACT

In an opening unit for open-end spinning machines, which comprises a housing and a roller lined with saw-tooth wire and rotatably arranged in the housing for separating the fibers along their path from the inlet to the outlet of the opening unit, a dirt separation duct is provided in the housing and is maintained under a reduced pressure. In the wall of the housing adjacent at least one side of the dirt separation duct a parallelizing element is inserted which comprises a plurality of saw tooth wire sections arranged in a side-by-side relationship and serving to balance the adverse effect of the dirt separation duct on the parallel flow of fibers on their path through the opening unit.

14 Claims, 2 Drawing Figures

OPENING UNIT FOR OPEN-END SPINNING MACHINES

BACKGROUND OF THE INVENTION

This invention relates to an opening unit for open-end spinning machines comprising an opening roller lined with sawtooth wire; a housing which surrounds this roller closely over part of its periphery; a delivery slot in the housing; a fibre guide duct following the housing in the direction of rotation of the opening roller and a dirt separation duct under reduced pressure which is situated between the delivery slot and the fibre guide duct.

In one known opening unit of this type, any particles of dirt present in the fibres are projected by centrifugal force into the dirt separation duct and are therefore unable to enter the spinning turbine. However, since the fibres entrained by the opening roller no longer have any hold in the region of the dirt separation duct, they are in danger of being removed from the opening roller by the centrifugal force and the slight reduced pressure prevailing in the dirt separation duct so that the quality of the yarn can be adversely affected.

The object of the present invention is to provide an opening unit of the type mentioned at the beginning in which the unfavourable effect of the dirt separation duct is avoided.

SUMMARY OF THE INVENTION

According to the invention, this object is achieved in that a parallelising segment formed from sawtooth wire sections is inserted into that wall of the housing which faces towards the opening roller at least on one side of the dirt separation duct. It has been found that a parallelising segment of this type increases the proportion of fibres which are linearly stretched in the peripheral direction of the opening roller so that the yarn is made more uniform.

One parallelising segment is preferably arranged on either side of the dirt separation duct.

The parallelising segments may form a single segment block which fits into a recess in the housing.

In one particular embodiment, each segment block has a base of trapezoidal cross-section and the housing comprises at least one dovetail groove shaped in accordance with the base.

It is favourable for the tooth pitch of the sawtooth wire sections to be in the range from 1.2 to 2.5 mm and for the sawtooth wire sections to be separated by an interval of from 1 to 3 1 mm from one another.

The segment blocks are preferably replaceable.

In another embodiment, the distance of the sawtooth wire sections from the opening roller is adjustable.

BRIEF DESCRIPTION OF THE DRAWINGS

One embodiment of the invention is described by way of example in the following with references to the accompanying diagrammatic drawings, wherein.

DESCRIPTION OF A PREFERRED EMBODIMENT

Figure 1:
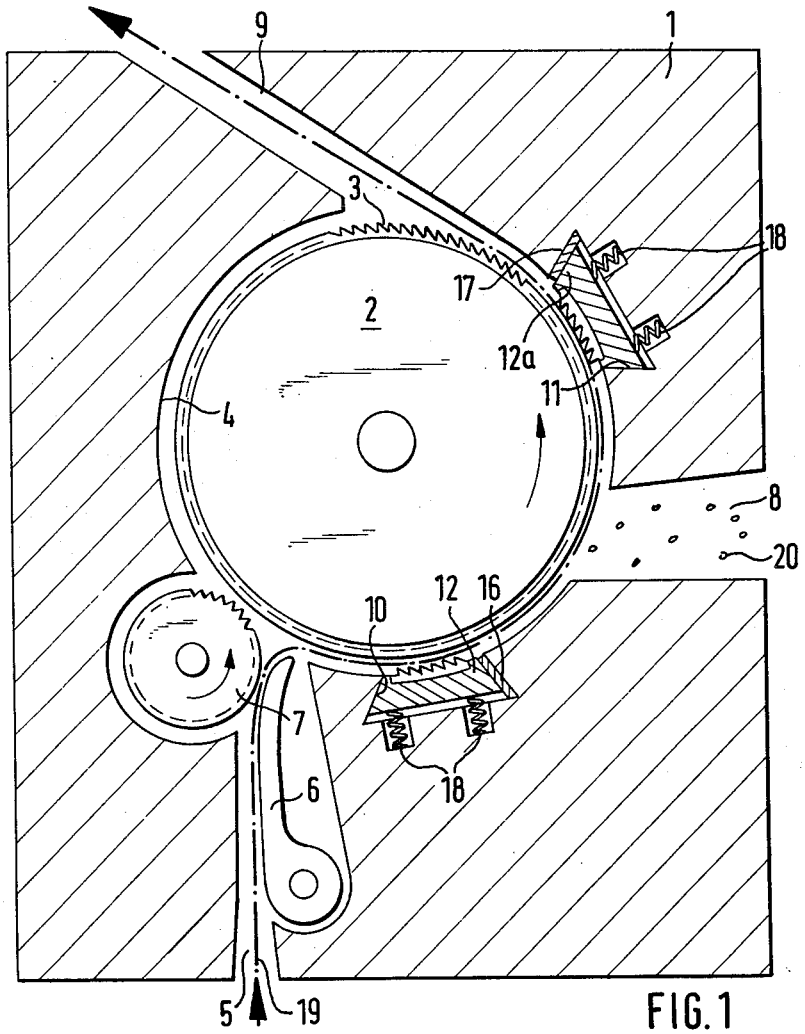
FIG. 1 is a cross-section through an opening unit according to the invention.

The opening unit shown in the drawings comprises a housing 1 provided with a cylindrical recess into which an opening roller 2 lined with sawtooth wire 3 is rotatably inserted. The distance between the tips of the sawtooth wire 3 and the inner wall 4 of the housing is less than 1 mm and is generally between 0.2 and 0.3 mm.

A delivery slot 5, to which the sliver 19 to be processed is delivered, opens into the cylindrical recess. The delivery slot is formed on one side by a recess in the housing and on the other side by a pivotally mounted clamping plate 6 of which the end adjacent the opening roller 2 is pressed by means which have not been shown against a grooved roller 7 which is mounted for rotation at low speed (as indicated by an arrow) in an opening in the housing.

The delivery slot 5 is followed in the direction of rotation of the opening roller 2 by a dirt separation duct 8 which is designed to connected to a reduced pressure source with slight reduced pressure.

The dirt separation duct 8 is followed in the direction of rotation of the opening roller by the fibre guide duct 9 which is under a higher reduced pressure than the dirt separation duct 8 and from which the fibres pass into a spinning turbine.

Figure 2:
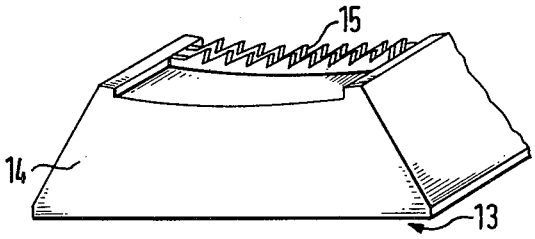
FIG. 2 is a perspective view of a segment block.

Starting out from the inner wall 4 of the housing 1, a dovetail groove 10 is provided in the region between the delivery slot 5 and the dirt separation duct 8 whilst another dovetail groove 11 is provided in the region between the dirt separation duct 8 and the fibre guide duct 9. Each of these grooves is intended to receive a segment block 13 which is shown in detail in FIG. 2.

The segment block 13 comprises a base 14 of trapezoidal cross-section of which the smaller base surface is formed with a flat recess of U-shaped cross-section in which sawtooth wire sections 15 are arranged adjacent one another and are fixed to the base 14, for example by bonding. The tips of the sawtooth wire sections are adjusted or rather ground in known manner in such a way that the tips of the teeth lie in one plane or on a cylindrically curved surface.

As can be seen from FIG. 1, one segment block 13 is inserted into each dovetail groove 10; 11 to act as a parallelising segment 12;12*a*, a shim plate 16;17 being inserted between a trapezoidal surface of each segment block 13 and the adjoining surface of the dovetail groove for the purpose of adjusting the required distance between the tips of the teeth of the parallelising segments and those of the lining of the opening roller 2. Compression springs 18 inserted into blind holes extending from the base of the dovetail grooves press the segment blocks 13 radially inwards so that the trapezoidal surfaces of the segment blocks 13 bear under pressure against the trapezoidal surfaces of the dovetail groove 10;11 either directly or through the shims 16;17. In this way, a more or less large interval may be adjusted between the parallelising segments 12,12*a* and the opening roller 2, depending on the thickness of the shims. The segment blocks may of course also be adjusted in other ways.

When the opening unit is in operation, a sliver 19 is guided into the delivery slot 5 and is transported by the groove roller 7 in conjunction with the clamping plate 6 into the vicinity of the opening roller 2 where the sliver is entrained anticlockwise by the sawteeth of the lining of the opening roller. The sliver is transported into the region between the first parallelising segment 12 and the opening roller, the individual fibres being additionally parallelised in this region. In addition, any particles of dirt which may still be present between the fibres are reduced in size. The fibres then move into the region of the dirt separation duct 8 where the particles of dirt 20 are separated from the fibres by centrifugal force in conjunction with the reduced pressure prevailing in the dirt separation duct. The fact that the fibres are not guided radially outwards in this region can interfere with their travel to an extent which is greater, the greater the length of the dirt separation duct 8 in the peripheral direction of the opening roller.

As they continue their travel, the fibres pass the parallelising segment 12*a* where they are again parallelised so that the troublesome effect of the dirt separation duct 8 is eliminated. In this way, substantially individual stretched fibres enter the fibre guide duct 9, providing for yarn of better quality than that obtained from standard conventional opening units in which no parallelising segments are present.

I claim:

1. An opening unit for an open-end spinning machine comprising:

an opening roller lined with sawtooth wire and having a direction of rotation;

a housing having a cylindrical wall closely surrounding said roller over part of its periphery;

delivery slot means in the housing;

a dirt separation duct under reduced pressure and located downstream of the delivery slot means;

a fiber guide duct downstream of said dirt separation duct;

a parallelizing segment formed from sawtooth wire sections and disposed in the wall of the housing between said dirt separation duct and said fiber guide duct, said segment being spring biased toward said roller;

whereby said parallelizing segment increases the proportion of fibers stretched linearly around the opening roller to increase the uniformity of yarn.

2. The opening unit according to claim 1 further comprising a second parallelizing segment between said dirt separation duct and said delivery slot means.

3. An opening unit according to claim 1, wherein said sawtooth wire sections have teeth separated by less than 1.5 mm.

4. An opening unit according to claim 1, wherein the sawtooth wire lining of the opening roller has teeth separated from the teeth of the sawtooth wire sections by less than 0.5 mm.

5. An opening unit according to claim 1, wherein said housing wall has a recess and said parallelizing segment forms a single segment block which fits into said recess.

6. An opening unit according to claim 5, wherein said segment block has a base of trapezoidal cross-section, and said housing wall defines at least one dovetail groove shaped in accordance with the base.

7. An opening unit according to claim 5, wherein said segment block is replaceable.

8. An opening unit according to claim 1, wherein said sawtooth wire sections are separated from one another by an interval of from 1 to 3 mm.

9. An opening unit according to claim 1, wherein the distance between said sawtooth wire sections and said opening roller is adjustable.

10. An opening unit for an open-end spinning machine as defined in claim 1, wherein one parallelizing segment is provided on either side of said dirt separation duct, said housing wall has a dovetail shaped recess, said parallelizing segment forming a single segment block having a base of trapezoidal cross-section which fits into the recess, said sawtooth wire sections has teeth separated by less than 1.5 mm, the teeth of said sawtooth wire sections are separated from the sawtooth wire lining the opening roller by less than 0.5 mm, said segment block is replaceable, said sawtooth wire sections are separated from one another by an interval of from 1 to 3 mm, and the distance between said sawtooth wire sections and said opening roller is adjustable.

11. An opening unit for an open ended spinning machine comprising:

an opening roller lined with sawtooth wire and rotatable in a direction of rotation;

a housing defining a bore surface closely surrounding said roller along part of its periphery and defining a delivery slot, a dirt separation duct, and a tangential fibre guide duct successively spaced in the direction of rotation and opening from said bore through said housing;

a source of reduced pressure connected to said dirt separation duct; and parallelizing segment means recessed in said bore surface adjacent and on both sides of said dirt separation duct and having sawtooth wire sections facing said roller, said parallelizing means being spring biased toward said roller.

12. An opening unit as in claim 11 wherein said housing defines a dovetail groove in said bore surface and said parallelizing means comprises a trapezoidal cross-section segment block fitting in the groove with the sawtooth wire sections facing the bore on the shorter parallel side of the block.

13. An opening unit as in claim 12 wherein said sawtooth wire sections have a tooth division of less than 1.5 mm, the sawtooth wire sections are separated from one another by an interval of 1 to 3 mm, and the minimum separation between the sawtooth wire sections and the sawtooth wire on the opening roller is less than 0.5 mm.

14. An opening unit as in claim 13 wherein the minimum separation between the sawtooth sections and the sawtooth wire on the opening roller is adjustable.

* * * * *